United States Patent [19]

Fox et al.

[11] Patent Number: 4,895,667

[45] Date of Patent: Jan. 23, 1990

[54] FABRIC TREATING COMPOSITIONS

[75] Inventors: Priscilla S. Fox, Phoenix; Barbara J. Felthouse, Scottsdale, both of Ariz.

[73] Assignee: The Dial Corporation, Phoenix, Ariz.

[21] Appl. No.: 198,181

[22] Filed: May 24, 1988

[51] Int. Cl.[4] ..... D06M 13/46

[52] U.S. Cl. ..... 252/8.8; 252/8.75; 252/547

[58] Field of Search ..... 252/8.6, 8.75, 547, 252/8.8

[56] References Cited

U.S. PATENT DOCUMENTS

| | | | |
|---|---|---|---|
| 3,033,704 | 5/1962 | Sherrill et al. | 117/47 |
| 3,356,526 | 12/1967 | Waldman et al. | 117/100 |
| 3,546,115 | 12/1970 | Gill et al. | 252/8.8 |
| 3,573,091 | 3/1971 | Waldman et al. | 117/100 |
| 3,644,204 | 2/1972 | Heins et al. | 252/8.8 |
| 3,681,241 | 8/1972 | Rudy | 252/8.75 |
| 3,862,045 | 1/1975 | Sato et al. | 252/8.75 |
| 3,904,359 | 9/1975 | Ramachandran | 8/137 |
| 3,920,564 | 11/1975 | Gricsek | 252/8.75 |
| 3,954,630 | 5/1976 | Ramachandran | 252/8.6 |
| 3,984,335 | 10/1976 | Ciko et al. | 252/8.6 |
| 4,102,825 | 7/1978 | Murata et al. | 252/547 |
| 4,298,480 | 11/1981 | Wixon | 252/8.75 |

FOREIGN PATENT DOCUMENTS 1550206 8/1979 United Kingdom .

*Primary Examiner*—Paul Lieberman
*Assistant Examiner*—John F. McNally
*Attorney, Agent, or Firm*—Richard G. Harrer; Bernard L. Howard

[57] ABSTRACT

Compositions capable of providing effective softness and antistatic properties to fabrics laundered therewith when such compositions are added to the wash cycle along with built anionic based detergents. The compositions include a combination of ethoxylated and/or propoxylated quaternary ammonium compounds, a monohigher alkyl quaternary ammonium compound and in a preferred form sodium citrate and/or boric acid. The compositions can be formulated in granular or liquid form.

14 Claims, No Drawings

FABRIC TREATING COMPOSITIONS

FIELD OF THE INVENTION

This invention relates to fabric treating compositions and more particularly, to compositions capable of imparting softness and antistatic properties to fabrics laundered therewith. The compositions of this invention are eminently suitable for addition to the wash cycle of a fabric laundry process and provide both effective softening and static control for such fabrics.

BACKGROUND OF THE INVENTION

The softening of fabrics during a laundering operation has been a part of the scene for about 30 years, beginning in the era when synthetic detergents began replacing soaps to launder fabrics. As long as soap was used for laundering, the hard water soap film left on the fabric provided the lubrication needed for a pleasing fabric hand. With the advent of synthetic detergents the need for a fabric softener was established.

The original fabric softeners were aqueous dispersions of cationic quaternary ammonium compounds such as the di (hydrogenated tallow) dimethyl ammonium chlorides and were added to the rinse cycle of the laundering operation.

With further technological changes responsible for the wide growth in synthetic fabrics, coupled with the increased use of automatic laundry dryers in the home, the importance of the softening effects of fabric softeners diminished somewhat, but the ability to eliminate static build-up on fabric became increasingly important. It was learned that fabric softeners could assist in reducing or preventing static in laundered fabrics which led to the discovery that softeners could be applied in the dryer as well as in the washing machine. The addition of a fabric softener to the fabric in the laundry dryer seems to improve static control but is actually less efficient in softening the fabric in that dryer added fabric softener sheets transfer to the fabric load a significantly less amount of fabric softener as do the wash or rinse cycle added products. The softener that is transferred in the dryer is concentrated on the surface of the fabrics and the result is that the softening effects are minimized, although the anti-static effect is enhanced over that obtained through rinse cycle application. With the advent of the nonionic detergents, it was found that the cationic softeners could be incorporated into the wash cycle as well. It had been previously recognized that the addition of cationic fabric softeners along with anionic based detergents in the wash cycle, substantially reduced both the cleaning efficiency of the detergent and the efficiency of the fabric softener. Thus there exists a need for a composition that can be added to the wash cycle of the laundering operation and which provides both effective softening and anti-static control while maintaining detergent efficiency with a wide range of detergents that include built anionic based products.

SUMMARY OF THE INVENTION

In our co-pending application No. 07/069,640 filed July 6, 1987, we disclose that compositions containing a combination of ethoxylated or propoxylated quaternary ammonium compounds, a mono-higher alkyl quaternary ammonium compound and powdered nylon provide effective softness and antistatic properties to fabrics laundered therewith.

The present invention is based upon the discovery that a composition comprising the combination of ethoxylated or propoxylated quaternary ammonium compounds and a mono-higher alkyl quaternary ammonium compound in certain proportions is effective in providing softness and anti-static properties to various types of fabrics such as cotton, cotton/synthetic fiber blends and synthetics, treated therewith in a laundering process. Such composition is effective when added to the wash cycle of the laundering process.

This invention also includes the discovery that the effectiveness of the foregoing combination is improved by incorporating a water soluble salt of citric acid, such as sodium citrate, and/or a weak acid such as boric acid along with said ethoxylated or propoxylated quaternary ammonium compounds and mono-higher alkyl quaternary ammonium compounds.

The ethoxylated quaternary ammonium compounds useful in the compositions are aliphatic cationic compounds characterized by the structure:

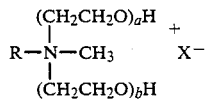

wherein R represents alkyl or alkenyl of 8–18 carbon atoms, and each of a and b are at least 1 and wherein the sum of a and b is from 2 to 50 X is $Cl^-$ or $CH_3SO_4^-$. Ethoxylated compounds of this type include methyl bis(2 hydroxyethyl) coco ammonium chloride available commercially as Ethoquad C/12 from Akzo Chemie America; Ethoquad C/25 which is the same as Ethoquad C/12 but wherein each of a and b represent 15 moles of ethylene oxide; Ethoquad 18/12 which is the same as Ethoquad C/12 except that R is octadecyl; and Ethoquad T/12 which is the same as Ethoquad C/12 except that R is tallow.

Propoxylated quaternary ammonium compounds useful in the composition are also aliphatic cationic compounds characterized by the structure:

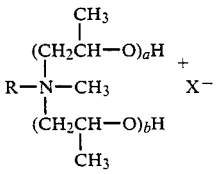

wherein R represents alkyl or alkenyl of 8–18 carbon atoms, and each of a and b are at least 1 and wherein the sum of a and b is from 2 to 50 X is $Cl^-$ or $CH_3SO_4^-$.

Such propoxylated compounds include Propoquad T/12 which is methyl bis(2-hydroxypropyl) tallow ammonium methyl sulfate; Propoquad C/12 which is the same as Propoquad T/12 except that R is coco; and Propoquad HT/12 which is the same as Propoquad T/12 except that R is hydrogenated tallow. All of the foregoing are available from Akzo Chemie America.

The foregoing are relatively ineffective as fabric softeners although they are considered to be reasonably effective as antistats in combination with unbuilt nonionic detergents.

The monoalkyl quaternary ammonium compounds are also aliphatic cationic compounds that conform to the formula:

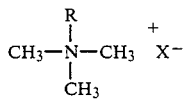

wherein R represents alkyl or alkenyl of 8 to 18 carbon atoms, preferably 12–18 carbon atoms, and X is $Cl^-$ or $CH_3SO_4^-$. Examples of the foregoing include trimethyl tallow ammonium chloride, trimethyl octadecyl ammonium chloride, trimethyl coco ammonium chloride, trimethyl hydrogenated tallow ammonium chloride and the like. The foregoing are commercially available from Akzo Chemie America under the trademark "Arquad". Although the di-higher alkyl quaternary ammonium chlorides (i.e., distearyl dimethyl ammonium chloride) are considered to be effective as softeners, particularly in the rinse cycle of a laundering process, the mono-higher alkyl compounds are in fact relatively ineffective as fabric softeners or as antistats. However, when such mono-higher alkyl quaternaries are combined with the ethoxylated and/or propoxylated quaternary ammonium compounds and most preferably including the water soluble salt of citric acid or a mild acid such as boric acid, the result is a very effective fabric softening-/antistat composition when used in the wash cycle of a laundering operation and even with built anionic based detergents.

The compositions of this invention can be formulated in either liquid or granular form. We find it important that the propoxylated and/or ethoxylated quaternary ammonium compound be present in the composition at a substantially higher level than the mono-higher alkyl quaternary. Thus, the ratio of the ethoxylated and/or propoxylated quaternary to the mono-higher alkyl quaternary on a weight basis ranges from about 85:1 to about 15:1, preferably from about 25:1 to about 40:1. All of the foregoing ratios are calculated on a 100% active basis. In a most preferred composition, from about 1% to about 5% of a water soluble salt of citric acid such as sodium citrate is added to the composition. The presence of sodium citrate, particularly in a liquid composition, acts as a processing aid in that it serves to solubilize the ethoxylated and/or propoxylated quaternary and the mono-higher alkyl quaternary. Additionally, the citrate enhances the softening qualities of the composition somewhat, although it probably does not have a substantial effect on static control. As will be seen from some of the examples, for reasons we are unable to explain, the inclusion of sodium citrate at levels of 2% and 3% by weight of the compositions had an adverse effect on softening performance although static control was acceptable. However, in those instances of poor softening performance, the inclusion of a mild acid, boric acid, in combination with the sodium citrate did serve to restore good softening. Additionally, a mild acid such as boric acid, enhances the softening qualities of the composition in the absence of sodium citrate.

In granular form the composition will contain from about 13% to about 35% by weight of the ethoxylated and/or propoxylated quaternary, with the preferred amount being from about 17% to about 24% by weight. It will be appreciated that the foregoing propoxylated and ethoxylated quaternary ammonium compounds are available only as fluids (ranging from about 70–95% active) and it is difficult to get a free-flowing granular composition at levels of such quaternaries much higher than about 35% by weight. The mono-higher alkyl quaternary ammonium compounds are also available as fluids (ranging from about 25–50% active) and are present at from about 0.15% to about 1.0% by weight. These quaternaries are not commercially available as pure compounds and thus the foregoing amounts are subject to change depending on the percentage or amount of the compound in the commercially available product. For example, methyl bis (2-hydroxy propyl) tallow ammonium chloride is available as a 75% active product. Trimethyl tallow ammonium chloride is available as a 26–29% active product.

Additional ingredients in the granular product include water soluble alkaline to neutral builder and filler salts in amounts up to about 80% by weight of the total composition as a carrier. Useful herein are the organic and inorganic builders including the alkali metal and alkaline earth metal phosphates, particularly the condensed phosphates such as the pyrophosphates or tripolyphosphates, silicates, borates, carbonates, bicarbonates and the like. Specific examples of such carrier materials include sodium tripolyphosphate, trisodium phosphate, tetrasodium pyrophosphate, sodium acid pyrophosphate, sodium monobasic phosphate, sodium dibasic phosphate, sodium hexametaphosphate, alkali metal silicates, sodium carbonate, sodium sulfate, borax, and the like and mixtures of the foregoing. Carrier salts may be selected so as to provide either a phosphate containing or phosphate free composition. Sodium carbonate and sodium sulfate are effective if a phosphate free composition is desired.

Other ingredients useful herein include fumed silica to promote the free flowing nature of the granular form, optical brighteners or bluing agents, and perfume.

To produce the granular composition, the dry builder and/or filler salts such as sodium tripolyphosphate and sodium sulfate are mixed together. The liquid materials, that is the ethoxylated and/or propoxylated quaternaries, the mono-higher alkyl quaternary, perfume and colorant are mixed together. Thereafter, the liquid material is added to the dry blend of builder and/or filler salts and mixed until thoroughly blended together. The sodium citrate, if used, is then added and mixing is resumed for a short period of time. Following the mixing, the product can be dried at ambient temperature until sufficiently dry to screen and package.

In formulating the composition in liquid form the constraints as to the amounts of the various quaternary ammonium compounds and sodium citrate and/or boric acid if used, are not present as with the product in granular form. In fact, it is possible to formulate a liquid product containing only the various quaternary ammonium compounds and sodium citrate and/or boric acid with no other diluents or solvents other than those that are contained in the commercially available components. However, depending on the useage directions, the composition will usually contain enough other liquids, usually water, so that from about 4 to about 8 ounces is added to a normal full load of laundry. However, we find that at least about 0.60% to about 1.0% or more of the cationic softener (on an active basis) based on the dry weight of the fabric being washed gives an optimum effect. Thus a washing machine taking a $5\frac{1}{2}$ pound load of fabrics requires from about 3 to about 7 gm of the cationic softener ingredients on a 100% active basis per pound of fabric or from about 16.5 to about 38 gm for such a load.

In formulating the composition in either a liquid or granular form, the active ingredients are diluted to a workable concentration. We find that when used in the wash cycle, from about at least 0.60% to about 1.0% of active ingredients or components based on the dry weight of the fabrics being washed gives a very good effect. Since the user is accustomed to directions in terms of cups, a convenient product active ingredient concentration ranges from about 13 to 21% with dosing requirements of about ½ cup for a typical full load.

To prepare a composition in liquid form the cationic quaternaries are mixed together. Thereafter, if sodium citrate and/or boric acid is to be included it is added and mixing is continued followed by the addition of water or other diluent.

The following examples are given for purpose of illustration only and are not intended to limit the invention. All parts and percentages are given by weight.

EXAMPLE I

Compositions in liquid form were prepared having the following components as a weight percentage of the composition:

| COMPONENT | A | B | C | D |
|---|---|---|---|---|
| Tallow methyl bis(2-hydroxypropyl ammonium) methyl sulfate) (Propoquad T/12)* | 24.1 | 23.0 | 22.65 | |
| Trimethyl tallow ammonium chloride (Arquad T-27W)** | 0.8 | 1.91 | 2.26 | 1.91 |
| Methyl bis(2-hydroxyethyl) tallow ammonium chloride (Ethoquad T/12)*** | | | | 23.0 |
| Sodium Citrate | 5.0 | 5.0 | 5.0 | 5.0 |
| Water, color, perfume | 70.1 | 70.09 | 70.09 | 70.09 |
| | 100.0 | 100.0 | 100.0 | 100.0 |

*as is basis-product is 75% active
**as is basis-product is 27% active
***as is basis-product is 75% active

EXAMPLE II

The compositions of Example I were evaluated for fabric softening and static control according to the following procedure:

The testing was done using a standard washing machine (Whirlpool) and electric dryer (Whirlpool). The samples of fabric to be laundered weighed 5.50 pounds and included 4 stripped color coded terry cloth swatches and the following fabric pieces, 2 polyester textured knits, 2 polyester jersey double knits, 4 pieces of Dacron/cotton sheeting material, and 2 yards each of 100% cotton print cloth, cotton broadcloth and nylon.

The controls of the washing machine were set for warm (104° F.) wash, cold rinse, high agitation, high spin and the appropriate water level. The wash time was set at 10 minutes. The machine was filled to the appropriate water level and 1 cup of a commercially available built anionic synthetic detergent and ½ cup of a composition of Example I was added. After allowing the machine to agitate for about 5 seconds, the samples of fabric were added and washed. Following washing, the load was transferred to the dryer and dried for about 50 minutes with the controls set for heavy fabric and high temperature. After drying was completed, all pieces of fabric were removed from the dryer and individually evaluated for static. The terry cloth swatches were evaluated for softness.

The evaluation for static and softness was made by skilled evaluators according to the following criteria:

STATIC EVALUATION

1. Severe static: fabrics cling together with a shocking sensation and crackling sounds upon manipulation of the fabric.
2. Moderate static: no clinging together of the fabric or shocking sensation upon handling the fabric but a slight cracking sound upon manipulation of the fabric.
3. Light static: no crackling sounds or shocking sensation with individual pieces of fabric repelling each other (fly away).
4. None: no clinging, shocking or crackling observed upon manipulation of the fabric.

SOFTNESS EVALUATION

1. Soft: fabric pliable with a light lubricated feel
2. Dry: lack of lubricity but still pliable.
3. Harsh: fabric stiff, rough, unpleasing to the touch The results of washing and drying the aforesaid fabrics using the compositions of Example I were as follows:

| | A | B | C | D |
|---|---|---|---|---|
| STATIC | none | none | none | none |
| SOFTNESS | soft | soft | soft | soft |

EXAMPLE III

Additional compositions in liquid form were prepared having the following components as a weight percentage of the composition:

| COMPONENT | E | F | G |
|---|---|---|---|
| Tallow methyl bis (2-hydroxypropyl) ammonium methyl sulfate) (Propoquad T/12)* | 23.0 | 12.45 | 2.26 |
| Trimethyl tallow ammonium chloride (Arquad T-27W)** | 1.91 | 12.45 | 22.65 |
| Methyl bis(2 hydroxy-ethyl tallow ammonium chloride (Ethoquad T/12)*** | | | |
| Sodium citrate | 5.0 | 5.0 | 5.0 |
| Water, color, perfume | 70.09 | 70.10 | 70.09 |
| | 100.0 | 100.0 | 100.0 |

The foregoing compositions were evaluated in accordance with the procedures of Example II with the following results:

| | E | F | G |
|---|---|---|---|
| STATIC | none | light | light |
| SOFTNESS | soft | harsh | harsh |

EXAMPLE IV

Compositions in liquid form were prepared having the following components as a weight percentage of the composition:

| COMPONENT | H | I | J |
|---|---|---|---|
| Tallow methyl bis (2-hydroxypropyl) ammonium methyl sulfate) (Propoquad T/12)* | 0.8 | | 19.92 |
| Trimethyl tallow ammonium chloride (Arquad T-27W)** | 24.1 | 23.0 | 1.99 |
| Methyl bis (2-hydroxyethyl) tallow ammonium chloride (Ethoquad T/12)*** | | 1.91 | |
| Sodium citrate | 5.0 | 5.0 | 5.0 |
| Water, color, perfume | 70.1 | 70.09 | 73.09 |
| | 100.0 | 100.0 | 100.0 |

The foregoing compositions were evaluated in accordance with the procedures of Example II with the following results:

| | H | I | J |
|---|---|---|---|
| STATIC | severe | light | none |
| SOFTNESS | harsh | harsh | soft |

EXAMPLE V

Compositions in liquid form were prepared to determine the effect of adding varying amounts of sodium citrate to the composition:

| COMPONENT | K | L | M | N | O |
|---|---|---|---|---|---|
| Tallow methyl bis (2-hydroxypropyl) ammonium methyl sulfate) (Propoquad T/12)* | 23.0 | 23.0 | 23.0 | 23.0 | 23.0 |
| Trimethyl tallow ammonium chloride (Arquad T-27W)** | 1.91 | 1.91 | 1.91 | 1.91 | 1.91 |
| Methyl bis (2-hydroxyethyl) tallow ammonium chloride (Ethoquad T/12)*** | | | | | |
| Sodium Citrate | 1.0 | 2.0 | 3.0 | 4.0 | 5.0 |
| Water, color, perfume | 74.09 | 73.09 | 72.09 | 71.09 | 70.09 |

The foregoing compositions were evaluated in accordance with the procedure of Example II with the following results:

| | K | L | M | N | O |
|---|---|---|---|---|---|
| STATIC | none | none | none | none | none |
| SOFTNESS | soft | harsh | harsh | soft | soft |

For reasons which we are unable to explain, it should be noted that the compositions which contained 2% and 3% by weight of sodium citrate did not give good softening performance, although static control was acceptable.

EXAMPLE VI

Compositions in liquid form were prepared to determine the effect of including boric acid in compositions containing 2% and 3% by weight of sodium citrate as well as to determine the effectiveness of boric acid as a total replacement for sodium citrate.

| COMPONENT | P | Q | R |
|---|---|---|---|
| Tallow methyl bis (2-hydroxypropyl) ammonium methyl sulfate) (Propoquad T/12)* | 23.0 | 23.0 | 23.0 |
| Trimethyl tallow ammonium chloride (Arquad T-27W)** | 1.91 | 1.91 | 1.91 |
| Methyl bis (2 hydroxyethyl) tallow ammonium chloride | | | |
| Boric Acid | 3.0 | 2.0 | 5.0 |
| Sodium citrate | 2.0 | 3.0 | |
| Water, color, perfume | 70.09 | 70.09 | 70.09 |
| | 100.0 | 100.0 | 100.0 |

The foregoing compositions were evaluated in accordance with the procedures of Example II with the following results:

| | P | Q | R |
|---|---|---|---|
| STATIC | none | none | none |
| SOFTNESS | soft | soft | soft |

In comparing compositions P and Q of this Example to L and M of Example V, it will be seen that the addition of boric acid to compositions containing 2% and 3% of sodium citrate did improve the softening effect of compositions L and M. Additionally, composition R demonstrates that boric acid seems to have the same effect as including sodium citrate at levels of 1%, 4% and 5%.

EXAMPLE VII

Compositions in liquid form were prepared to determine the effectiveness of such compositions in the absence of sodium citrate.

| COMPONENT | S | T | U | V |
|---|---|---|---|---|
| Tallow methyl bis (2-hydroxypropyl) ammonium methyl sulfate) (Propoquad T/12)* | 24.1 | 22.65 | 0.8 | 2.26 |
| Trimethyl tallow ammonium chloride (Arquad T-27W)** | 0.8 | 2.26 | 24.1 | 22.65 |
| Methyl bis (2-hydroxyethyl) tallow ammonium chloride (Ethoquad T/12)*** | | | | |
| Sodium citrate | | | | |
| Water, color, perfume | 75.1 | 75.09 | 75.1 | 75.09 |
| | 100.0 | 100.0 | 100.0 | 100.0 |

The foregoing compositions were evaluated in accordance with the procedures of Example II except that the samples of fabric to be laundered weighed 2.75 pounds, ½ cup of anionic detergent was used and ¼ cup of each of the compositions of this Example VII was used. The following results were obtained.

| | S | T | U | V |
|---|---|---|---|---|
| STATIC | none | none | severe | light |
| SOFTNESS | soft | soft | harsh | harsh |

The foregoing tests show that it is necessary that the amount of propoxylated and/or ethoxylated quaternary present in the composition be greater than the amount of mono-higher alkyl quaternary to get effective conditioning of the treated fabrics. Additionally, the tests show that sodium citrate is not required to give effective softening and static control in the wash cycle.

EXAMPLE VIII

A test was run to determine the effect of reducing the level of the various components of a fabric treating composition. A composition in liquid form was prepared having the following components as a weight percentage of the composition.

| COMPONENT | W |
|---|---|
| Tallow methyl bis (2-hydroxypropyl) ammonium methyl sulfate) (Propoquad T/12)* | 13.6 |
| Trimethyl tallow ammonium chloride (Arquad T-27W)** | 1.4 |
| Methyl bis (2-hydroxyethyl) tallow ammonium chloride (Ethoquad T/12)*** | |
| Sodium citrate | |
| Water | 85.0 |
| | 100.0 |

The foregoing composition was evaluated in accordance with the procedure of Example VII with the following results:

| | W |
|---|---|
| STATIC | light |
| SOFTNESS | harsh |

Although composition W contained more of the propoxylated quaternary than the mono-higher alkyl quaternary (a ratio of about 10:1 on an "as is" basis and a ratio of about 25:1 on an actual basis) both static control and softness were unsatisfactory. Such results should be compared to composition T of Example VII where about the same ratio of propoxylated quaternary to mono-higher alkyl quaternary was used but at a higher level. The total amount of quaternaries present in composition W on an active basis was about 10.6% whereas the total amount of quaternaries present in composition W on an active basis was about 17.6%.

Thus, composition T at a usage level of ¼ cup (2 ounces) provided about 10.4 gm of the cationic quaternaries on a 100% active basis. Based on the weight of the fabric which was washed (2.75 pounds), composition T provided about 3.8 gm per pound of fabric. Composition W, on the other hand, at a usage level of ¼ cups (2 ounces) provided about 6.3 gm of the cationic quaternaries on a 100% active basis. Based on the weight of the fabric (2.75 pounds), composition W provided about 2.3 gm of cationics per pound of fabric. Thus, the composition to the effective should provide at least about 3.0 gm of cationic quaternaries per pound of fabric being washed.

What is claimed is:

1. A composition capable of imparting softness and antistatic properties to fabrics treated therewith in the wash cycle of a laundering process comprising:

(1) an aliphatic cationic compound selected from the group consisting of:

(a) an ethoxylated quaternary ammonium compound characterized by the structure:

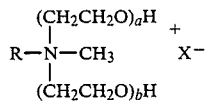

wherein R represents alkyl or alkenyl of 8–18 carbon atoms, each of a and b are at least 1 and the sum of a plus b is from 2 to 50 and X is $Cl^-$ or $CH_3SO_4^-$, (b) a propoxylated quaternary ammonium compound characterized by the structure:

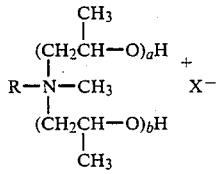

wherein R represents alkyl or alkenyl of 8–18 carbon atoms, each of a and b are at least 1 and the sum of a plus b is from 2 to 50 and X is $Cl^-$ or $CH_3SO_4^-$ and mixtures of (a) and (b), and (2) a cationic mono long chain alkyl quaternary ammonium compound characterized by the structure:

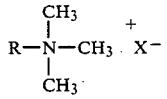

wherein R represents alkyl or alkenyl of 8 to 18 carbon atoms and X is $Cl^-$ or $CH_3SO_4^-$, and wherein the ratio on a weight basis of said ethoxylated compound, said propoxylated compound and mixtures thereof to said mono long chain compound is from about 85:1 to about 15:1 and wherein said composition is formulated to deliver at least about 0.60% of said cationic compounds based on the weight of the fabrics being washed.

2. A composition according to claim 1 wherein the aliphatic cationic compound (1) is a propoxylated quaternary ammonium compound (b) and wherein said ratio is about 25:1 to about 40:1.

3. A composition according to claim 2 wherein R of the propoxylated quaternary ammonium compound (b) is tallow and the sum of a plus b is 2.

4. A composition according to claim 3 wherein the mono long chain quaternary ammonium compound (2) R is tallow and X is $Cl^-$.

5. A composition according to claim 1 wherein the content of the aliphatic cationic compound (1) is at least about 13% by weight of the composition, the content of the mono long chain quaternary ammonium compound (2) is at least about 0.15% by weight of the composition.

6. A composition according to claim 1 additionally containing a compound selected from water soluble salts of citric acid and a weak acid and mixtures thereof and wherein the water soluble salt of citric acid when present in said composition in the absence of said weak acid is present in the composition at a level of less than 2% by weight of the composition and more than 3% by weight of the composition.

7. A composition according to claim 6 wherein said water soluble salt of citric acid is sodium citrate and wherein said weak acid is boric acid.

8. A composition according to claim 6 containing from about 1% to about 5% by weight of a mixture of said water soluble salt of citric acid and said weak acid.

9. A composition according to claim 6 wherein the content of the aliphatic cationic compound (1) is from about 13% to about 35% by weight of the composition, the content of the mono long chain quaternary ammonium compound (2) is from about 0.15% to about 1.0% by weight of the composition.

10. A composition according to claim 9 wherein the aliphatic cationic compound (1) is a propoxylated quaternary ammonium compound (b).

11. A composition according to claim 10 wherein R of the propoxylated quaternary ammonium compound (b) is tallow and the sum of a plus b is 2.

12. A composition according to claim 9 wherein the content of said aliphatic compound (1) is from about 17% to about 24% by weight of the composition.

13. A composition according to claim 12 containing from about 1% to about 5% by weight of a mixture of sodium citrate and boric acid.

14. A composition according to claim 12 containing from about 1% to about 5% by weight of boric acid.

* * * * *